US011235567B2

(12) United States Patent
Izume

(10) Patent No.: US 11,235,567 B2
(45) Date of Patent: Feb. 1, 2022

(54) INK FOUNTAIN DEVICE

(71) Applicant: I.MER CO., LTD., Kyoto (JP)

(72) Inventor: Masayuki Izume, Kyoto (JP)

(73) Assignee: I.MER CO., LTD., Kyoto (JP)

( * ) Notice: Subject to any disclaimer, the term of this patent is extended or adjusted under 35 U.S.C. 154(b) by 10 days.

(21) Appl. No.: 16/609,056

(22) PCT Filed: Dec. 19, 2018

(86) PCT No.: PCT/JP2018/046733
§ 371 (c)(1),
(2) Date: Oct. 28, 2019

(87) PCT Pub. No.: WO2019/181115
PCT Pub. Date: Sep. 26, 2019

(65) Prior Publication Data

US 2020/0147955 A1 May 14, 2020

(30) Foreign Application Priority Data

Mar. 22, 2018 (JP) ..... JP2018-054119

(51) Int. Cl.
*B41F 31/26* (2006.01)

(52) U.S. Cl.
CPC ..... *B41F 31/26* (2013.01)

(58) Field of Classification Search
CPC ..... B41F 31/05; B41F 31/04; B41F 31/045; B41F 31/02; B65G 39/025
See application file for complete search history.

(56) References Cited

U.S. PATENT DOCUMENTS 2,949,992 A * 8/1960 Weinberg ..... B65G 13/12 193/35 MD
4,328,748 A * 5/1982 Schramm ..... B41F 31/04 101/365
6,178,887 B1 * 1/2001 Hachiya ..... B41F 31/04 101/351.2

FOREIGN PATENT DOCUMENTS

CN 106113936 A 11/2016
CN 206299262 U 7/2017
JP 3194174 B2 3/1995

* cited by examiner

*Primary Examiner* — Leslie J Evanisko
*Assistant Examiner* — Leo T Hinze
(74) *Attorney, Agent, or Firm* — The Webb Law Firm; James Gerard Porcelli

(57) ABSTRACT

An ink fountain device having a base; a plate; an advancing and retracting mechanism for advancing and retracting the plate along an advancing and retracting direction; and a thin sheet arranged on the base which has plural holes accommodating balls and is thinner in thickness than a diameter of the balls. The plate is arranged over the thin sheet and supported by the balls.

3 Claims, 6 Drawing Sheets

INK FOUNTAIN DEVICE

CROSS-REFERENCE TO RELATED APPLICATIONS

This application is the United States national phase of International Application No. PCT/JP2018/046733 filed Dec. 19, 2018, and claims priority to Japanese Patent Application No. 2018-054119 filed Mar. 22, 2018, the disclosures of which are hereby incorporated by reference in their entirety.

FIELD OF THE INVENTION

The present invention relates to an ink fountain device to be used in printing presses.

BACKGROUND ART

Ink fountain devices are installed in printing presses, such as offset printing presses and relief printing presses; they face ink fountain rollers in the presses to form ink fountains (reserves of ink) between them. An adjustable clearance between an ink fountain device and an ink fountain roller is meritorious; for example, if the clearance may temporarily be made wider during printing, then dust, such as paper dust, clogging the clearance may be removed.

Patent Document 1 (JP3194174B) describes adjusting the clearance between an ink fountain device and an ink fountain roller by rotating the ink fountain device. However, it is not easy to adjust the clearance accurately by this mechanism.

PRIOR ART DOCUMENT

Patent Document

Patent Document 1: JP3194174B

SUMMARY OF THE INVENTION

Problem to be Solved by the Invention

The present inventor has investigated to compose an ink fountain device by a base and a slide plate on the base and to adjust the clearance between the ink fountain device and the ink fountain roller by moving the plate back and forth. If the friction between the base and the plate is sliding friction, a large output motor is necessary for moving the plate back and forth because of the large frictional resistance. But, members such as linear motion guides between the plate and the base make the advancing and retracting mechanism large and costly.

The object of the invention is to reduce the friction between the base and the plate by a simple mechanism.

Means for Solving the Problem

An ink fountain device according to the invention forms an ink fountain when facing an ink fountain roller of a printing press, is characterized by:

a base; a plate; an advancing and retracting mechanism for advancing and retracting the plate along an advancing and retracting direction; and a thin sheet arranged on the base, having plural holes accommodating balls, and being thinner in thickness than a diameter of said balls, and is characterized in that said plate is arranged over the thin sheet and supported by said balls.

According to the invention, the plate is supported by the balls over the base and therefore is advanced and retracted by a small force. As a result, a small size motor is enough for advancing and retracting the plate. The balls are retained within holes in the thin sheet, for example, with grease. Since a large number of the holes are provided, the plate is supported by a large number of the balls. When the bottom face of the plate and the balls are made into close contact by some means, the intrusion of ink, paper dust, cleaning liquid, or the like is prevented. Therefore, without maintenance such as cleaning of the holes or greasing in them, the ink fountain device can be operated for a long period.

Preferably, a plurality of resilient members are provided for energizing the plate towards the base and are connected at their both ends to both the base and the plate. When the plate is adsorbed on the base by magnets or the like, it becomes a resistance against the advancement and retraction of the plate. On the contrary, when the plate is energized towards the base by the resilient members, the energizing direction and the advancement and retraction direction are orthogonal, and the energizing force does not hinder the advancement and retraction of the plate.

Preferably, at least a bearing roller is provided on one of the base and the plate, and at least a recess accommodating the bearing roller is provided in the other of the base and the plate. When the plate is pressed to shift beyond an allowable range along a perpendicular direction to the advancing and retracting direction, the bearing roller is made in contact with the recess. Therefore, the plate does not shift along the direction perpendicular to the advancing and retracting direction over the clearance between the bearing roller and the recess. Besides, when the bearing roller contacts the recess, the bearing roller is rotated without wearing. Therefore, the position of the plate along the direction perpendicular to the advancing and retracting direction is regulated for a long period.

Preferably, the advancing and retracting mechanism comprises: a pair of motors joined to the base; a pair of cams rotating with output shafts of the pair of motors and having circumferential surfaces constituting cam surfaces; a pair of rods in contact with the cam surfaces and advancing and retracting along the advancing and retracting direction according to the rotation of the motors; and a pair of connection members connecting the rods to the plate. When the pair of the motors are rotated by the same angle, the pair of the rods advance and retract by the same distance, and the plate advances and retracts relative to the base by the same distance at two points. Further, the cams allow the plate to advance and retract accurately with a small stroke.

Preferably, the advancing and retracting mechanism comprises: a pair of threaded holes provided on the plate; a pair of screws engaged with the pair of threaded holes; a pair of arms joined to the pair of screws; a rod connecting the pair of arms; a motor making one of the pair of arms rotate; and a pair of association members fixing axial positions of the pair of screws relative to the base. Thus, the plate, the pair of arms, and the rod constitute a quadric link. Further, a member is rotatably attached on the one of the pair of arms. One of the member and an output shaft of the motor is provided with a screw, and the other of the member and the output shaft of the motor is provided with a threaded hole such that the screw is engaged with the threaded hole. When the motor is rotated, one of the arms is rotated, and the other arm is rotated by the same angle according to the quadric link. The pair of arms are connected to the screws respectively; the rotation of the motor is converted to the rotations of the screws, and the plate advances and retracts because of the engagements between the screws and the threaded holes on the plate. Therefore, the plate advances and retracts accurately with a small stroke.

DETAILED DESCRIPTION OF THE INVENTION

The best embodiment for carrying out the invention will be described in the following.

Embodiments

Figure 1:
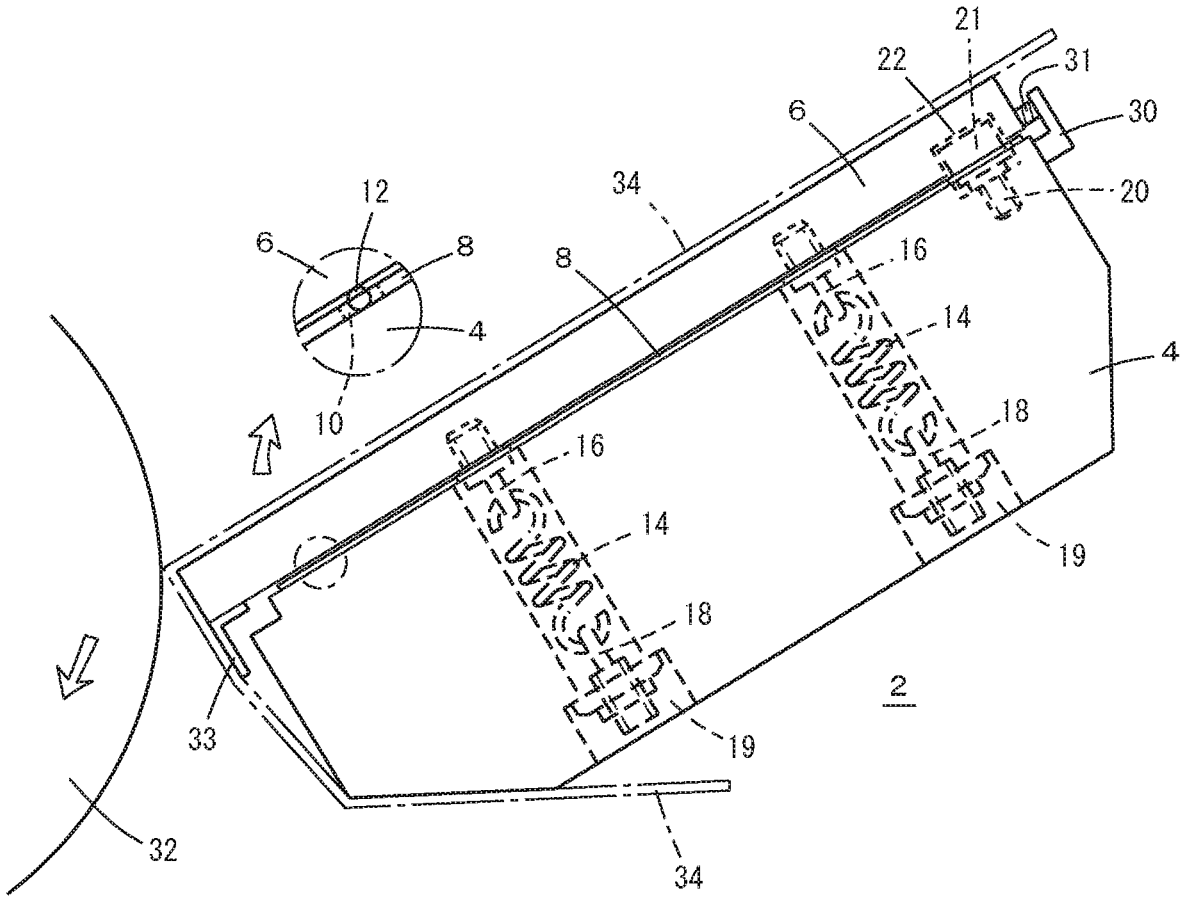
FIG. 1 A side view of an ink fountain device according to an embodiment.

FIGS. 1-8 show an ink fountain device 2 according to an embodiment and a modification. The ink fountain device 2 faces an ink fountain roller 32; the ink reserved between them forms an ink fountain. As shown in FIG. 1, the ink fountain device 2 is provided with a base 4 and a plate 6; the base 4 is joined to a printing press, such as an offset printing press, or a relief printing press. The plate 6 is supported by the base 4 and advances towards the ink fountain roller 32 and retracts from the roller 32.

A thin sheet 8 is provided between the base 4 and the plate 6. As enlargedly shown in a left upper portion in FIG. 1, the thin sheet 8 is provided with a large number of holes 10; the holes 10 retain balls 12 and grease not shown, and a large number of the balls 12 support the plate 6. The holes 10 are penetrating holes, but they may be holes having bottoms. A slight gap is made between the upper surface of the thin sheet 8 and the bottom face of the plate 6 so that the plate 6 is supported by the base 4 and may slide. The thin sheet 8 is, for example, a thin steel plate, the balls 12 are, for example, steel balls, but the materials for them are arbitrary. The thin sheet 8 retains a large number of the balls 12, and, since the thin sheet 8 is slightly thinner than the diameter of the balls 12, the thin sheet 8 and the plate 6 are not in contact. Further, the diameter of the holes 10 are larger than the diameter of the balls 12, the ball 12 rotates and moves within the hole 10, and the hole 10 retains grease with the ball 12.

A plurality of resilient members 14 energize the plate 6 towards the base 4 so that the bottom face of the plate 6 is made in close contact with the balls 12 and that the gap between the base 4 and the plate 6 is made narrower. This prevents the ink, paper dust, liquid cleaners for the plate 6, and so on, from entering into the gap between the plate 6 and the thin sheet 8. The resilient members 14 are, for example, tensile springs and the species of the resilient members are arbitrary. Hooks 16, 18 support the two ends of the resilient members 14; the base portions of the hooks 16 are screwed on the plate 6, and the base portions of the hooks 18 are accommodated within recesses 19 and screwed on the base 4. The resilient members 14 make the plate 6 elastically energized towards the base 4 and a plurality of the members are provided between the plate 6 and the base 4 so as to make them in close contact over the entire surface.

Indicated by 20 is a bearing roller; the base portion of it is screwed on the base 4, and the roller part 21 at the tip end is accommodated in a recess 22 of the plate 6. When the plate 6 is pressed to shift beyond an allowable range along the normal direction to the paper plane in FIG. 1 (the lateral direction in the specification), the roller part 21 contacts on a sidewall of the recess 22. In this way, the lateral position of the plate 6 relative to the base 4 is regulated. By the way, on the contrary to FIG. 1, the base portion of the bearing roller 20 may be fixed to the plate 6, and the roller part 21 and the recess 22 may be provided towards and in the base 4. Since the wear is negligible when the bearing roller 20 is made in contact with the recess 22, the bearing roller 20 may regulate the lateral position of the plate 6 during the service life of the ink fountain device 2 without the exchange of the roller 20.

L-shaped pieces 30, for example, a left and right pair of them, are joined to the base 4, and compressed springs 31 are provided between the L-shaped pieces and the plate 6 so that the plate 6 is energized towards the ink fountain roller 32 at the left side in FIG. 1. Here, the left and right direction (the lateral direction) is the lengthwise direction of the base 4 and the plate 6. Besides, an L-shaped piece 33 is provided along the underside of the tip end of the plate 6 towards the ink fountain roller 32 to prevent ink or the like from intruding. The L-shaped piece 33 may not be provided. Further, the exterior surface of the plate 6 may be covered by a plastic film 34 shown by a chain line in FIG. 1 so that the ink does not contact the plate 6.

Figure 2:
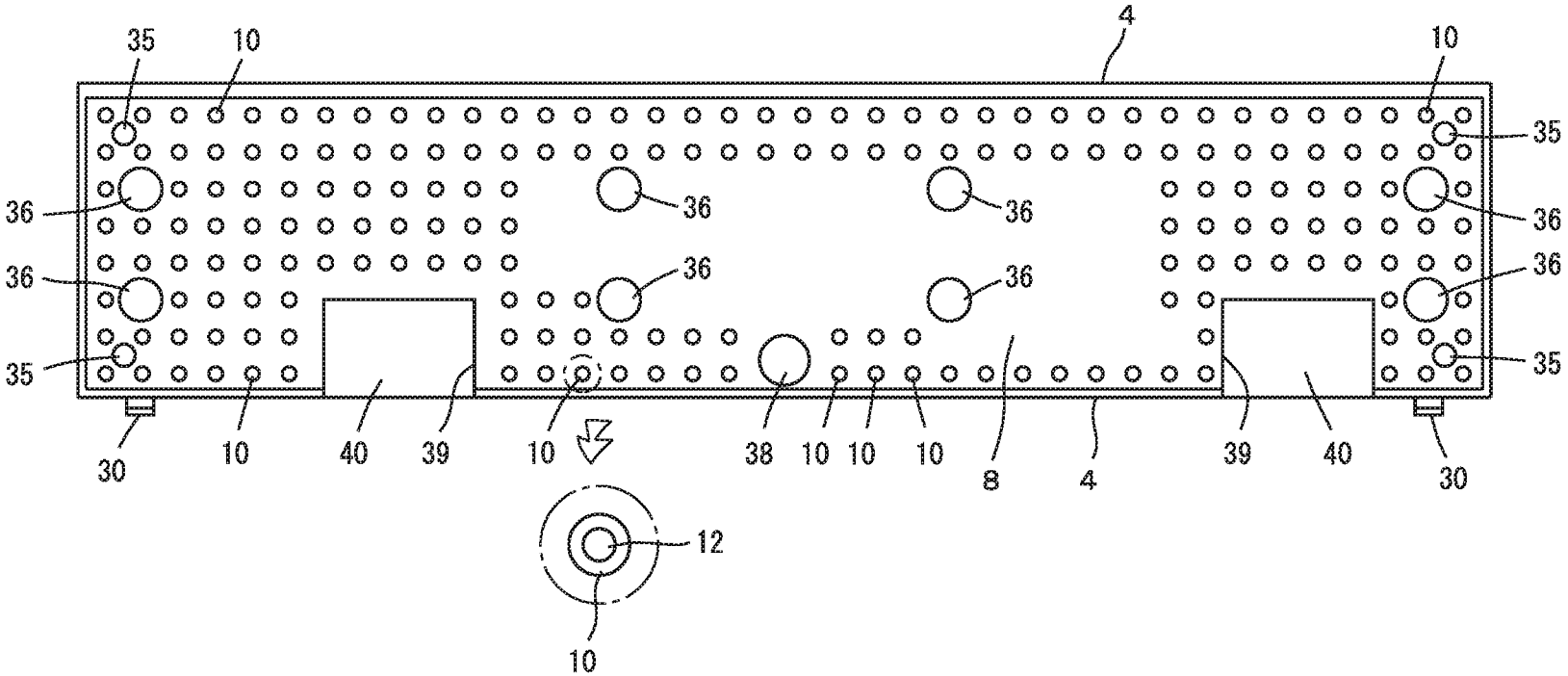
FIG. 2 A plan view of a thin sheet on a base in the ink fountain device according to the embodiment.

FIG. 2 indicates the thin sheet 8 on the base 4, and the bottom surface of the plate 6 is stacked over the sheet. The holes 10 are arranged on the surface of the thin sheet 8, and each hole 10 retains a ball 12. Indicated by 35 are holes for inserting screws to fix the thin sheet 8 on the base 4 by the screws. Even if the thin sheet 8 is not fixed to the base 4, the thin sheet 8 does not move and does not extend beyond the base 4. Therefore, the thin sheet 8 may not be fixed to the base 4. The threaded portions of the hooks 16 are inserted in holes 36 of the thin sheet 8, and the threaded portion of the bearing roller 20 is inserted in a hole 38. Further, within cut-out portions 39 in the thin sheet 8 and within recesses 40 in the base 4, the advancing and retracting mechanisms 28 are accommodated so that the plate 6 is made advancing and retracting towards and from the ink fountain roller 32. In the specification, the movement towards the ink fountain roller 32 is called advancement and the movement from the roller 32 is called retraction.

Figure 3:
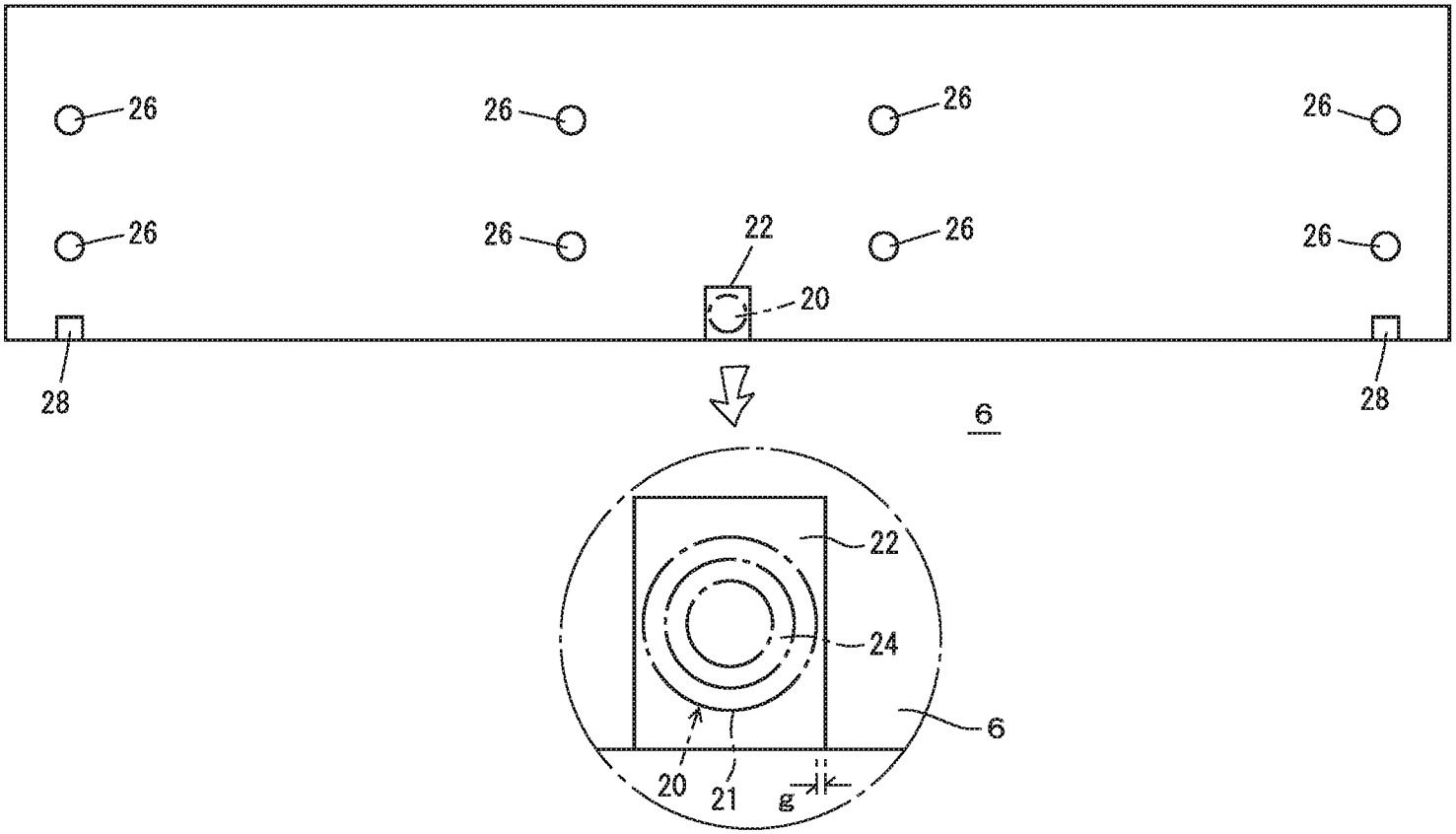
FIG. 3 A bottom view of a plate in the ink fountain device according to the embodiment.

FIG. 3 shows the bottom of the plate 6. The recess 22 is provided, for example, at one portion in or near the center portion along the lengthwise direction and accommodates the roller part 21 of the bearing roller 20. Here, indicated by 24 is a bearing. The recess 22 is, for example, rectangular and its lengthwise direction is parallel to the up-down direction in FIG. 3. There is a slight clearance g between the left and right side walls of the recess 22 and the roller part 21, and the plate 6 can not shift beyond the clearance g along the left and right direction in FIG. 3. In this way, the position of the plate 6 is regulated along the left and right direction of the plate 6 (the lengthwise direction of the ink fountain device 2). The base portions of the hooks 16 are screwed on threaded holes 26.

Figure 4:
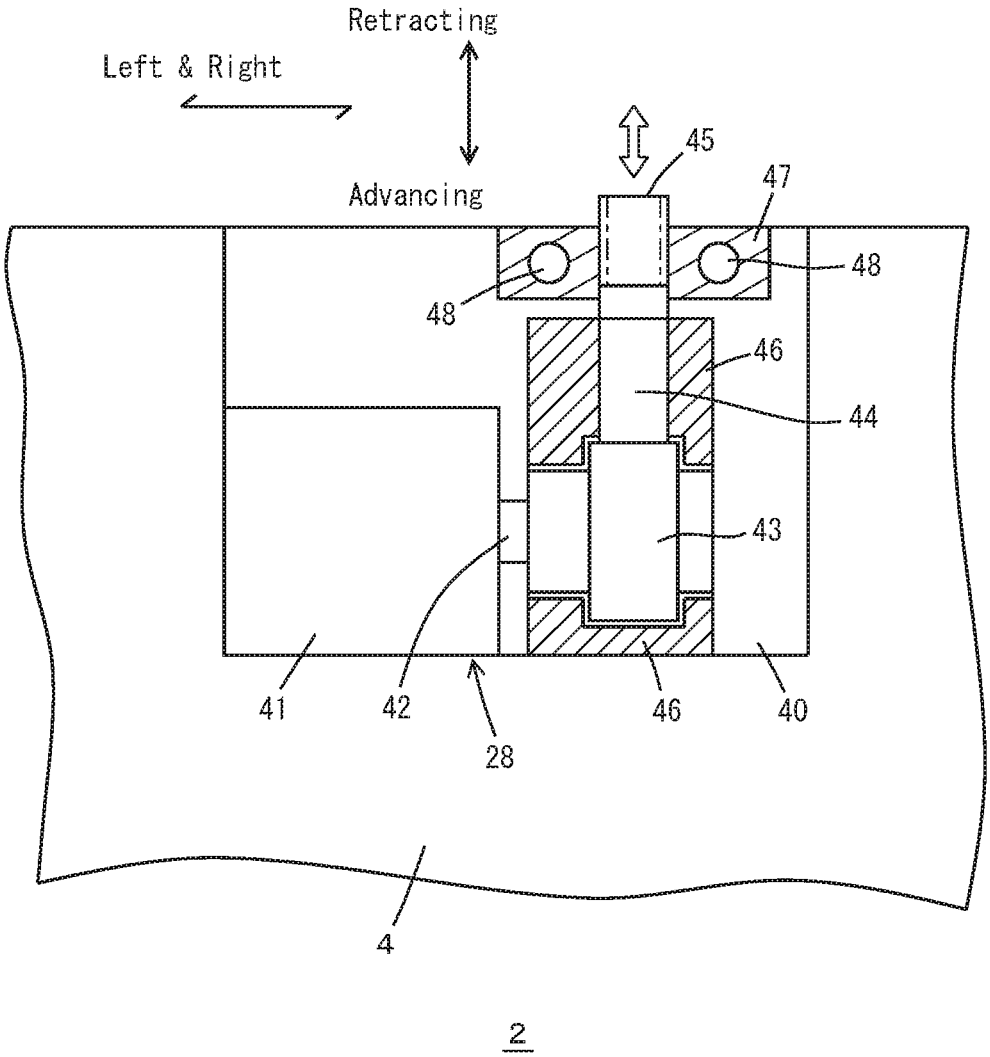
FIG. 4 A plan view of an advancing and retracting mechanism in the ink fountain device according to the embodiment.
Figure 5:
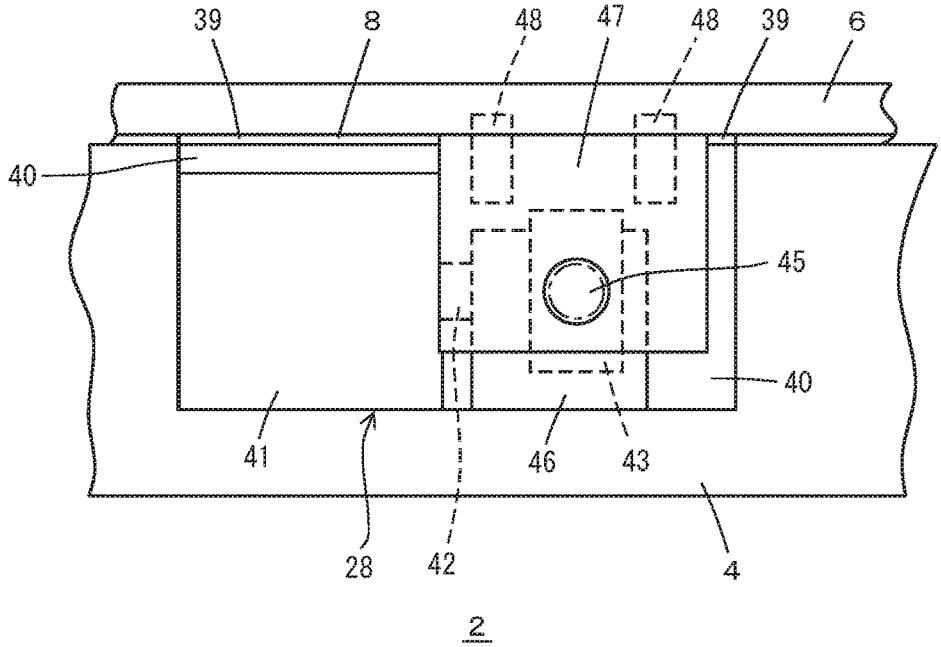
FIG. 5 A front view of the advancing and retracting mechanism in the ink fountain device according to the embodiment.
Figure 6:
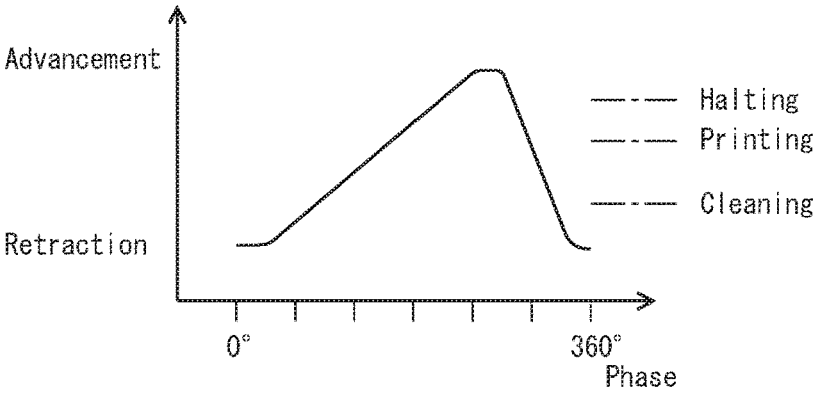
FIG. 6 A diagram showing the phase of an eccentric cam and the advancement and retraction of the plate in the ink fountain device according to the embodiment.

FIGS. 4 to 6 show the advancing and retracting mechanism 28 for the plate 6. Indicated by 41 is a servo-motor; it may be a simpler motor such as a pulse motor. The servo-motor 41 has a driving shaft 42 on which an eccentric cam 43 is fixed. The cam 43 is, for example, circular, and the center of the cam 43 and the center of the driving shaft 42 is slightly shifted. This shift makes the plate 6 advance and retract; the circumferential surface of the cam 43 constitutes the cam surface. One end of a rod 44 is kept in contact with the cam surface, and the other end of the rod 44 is kept in contact with an adjustment screw 45. Further, the adjustment screw 45 is screwed on an attachment plate 47, the plate 47 is fixed to the plate 6 by a couple of knock pins 48. Besides, the cam 43 is accommodated within a casing 46 and is freely rotatable, and the attachment method of the plate 47 to the plate 6 is arbitrary. One of the left and right pair of the advancing and retracting mechanisms 28, 28 may not be provided with the servo-motor 41. For example, only one of the left and right advancing and retracting mechanisms may be provided with the servo-motor 41, and the cam 43 in the other advancing and retracting mechanism may be driven by a shaft extending between the left and right recesses 40, 40.

The function of the advancing and retracting mechanism 28 will be described. The relation between the phase of the cam 43 and the advancing and retracting quantity of the plate 6 (the change in the distance between the cam surface and central axis of the cam) is indicated in FIG. 6. The horizontal axis indicates the phase of the cam 43 and the vertical axis indicates the tip end position of the plate 6. The chain lines indicate the three positions of the tip end of the plate; at the most advancing "halting," the tip end of the plate 6 is in close contact with the ink fountain roller 32 so as to prevent the ink from leaking. This position is provided to prevent the ink from leaking when the printing press is halted with the ink being reserved in the ink fountain, but this position may not be provided. At the "printing" position, the clearance between the tip end of the plate 6 and the ink fountain roller 32 is one suitable for the printing. Dust such as paper dust is removed at the "cleaning" position where the tip end of the plate 6 is retracted and the dust clogged between the ink fountain roller 32 and the plate 6 is removed. The cam 43 rotates between these three positions.

Since the plate 6 is energized towards the advancing direction by the compressed spring 31, the one end of the rod 44 is always in contact with the cam surface of the cam 43, and the other end is always in contact with the adjustment screw 45. When the cam 43 is rotated by the servo-motor 41, the rod 44 advances and retracts, and therefore, the attachment plate 47 advances and retracts via the adjustment screw 45. Since the plate 6 is fixed to the plate 47 via the knock pins 48, the plate 6 advances and retracts according to the rotation of the cam 43. In this way, the plate 6 advances and retracts accurately with a small stroke by the servo-motor 41, the eccentric cam 43, and the rod 44 connected to the plate 6.

Figure 7:
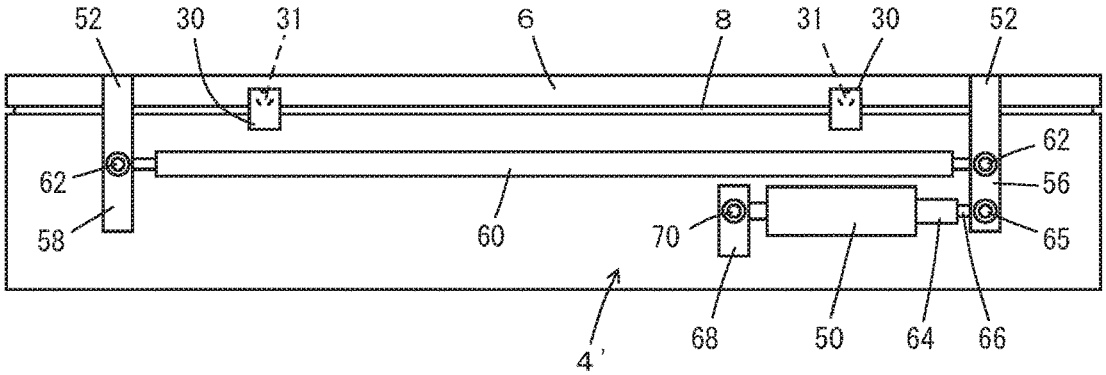
FIG. 7 A front view of an ink fountain device according to a modification.
Figure 8:
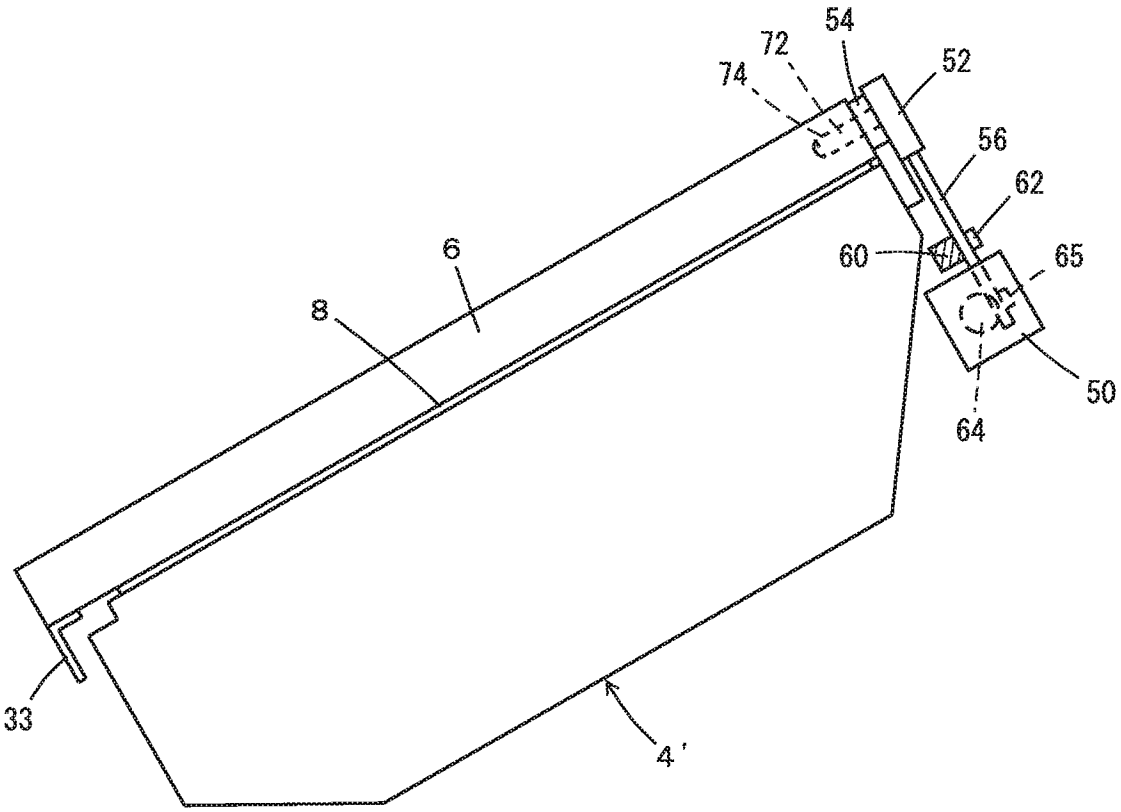
FIG. 8 A side view of the ink fountain device according to the modification.

FIGS. 7 and 8 indicate a modification of the advancing and retracting mechanism having the following features in common with the embodiment:

the thin sheet 8 is provided between a base 4' and the plate 6 and the balls 12 are retained in the thin sheet 8;

the plate 6 is energized towards the base 4' by plural resilient members 14; and the left and right directional position of the plate 6 is regulated by the bearing roller 20.

Indicated by 50 is a servo-motor and it may be another motor such as a pulse motor. A left and right pair of connection members 52 are fixed to the plate 6 by screws 72 shown in FIG. 8. The plate 6 has threaded holes 74 which are engaged with the screws 72. Further, association members 54 fixed to the base 4' support the shanks of the screws 72. The association members 54 comprise ring-like members supporting the shanks of the screws 72 or shafts of the connection members 52. The connection members 52 are rotatable with the screws 72 relative to the association members 54, and the axial positions of the screws 72 are fixed.

As shown in FIG. 7, an arm 56 is fixed to one of the connection members 52 and another arm 58 is fixed to the other of the connection members 52. Further, the two ends of a rod 60 that is parallel to the lengthwise direction of the base 4' are connected to the arms 56, 58 by pins 62, 62 so that the rod is allowed to rotate around the pins. Besides, a pin 65 is connected to the arm 56 rotatably and it has an integral threaded portion 66; the threaded portion is screwed on a threaded hole on the shaft 64 of the servo-motor 50. The opposite end of the servo-motor 50 to the shaft 64 is connected to a bracket 68 fixed to the base 4' by a pin 70 so that the servo-motor is allowed to rotate around the pin.

The function of the advancing and retracting mechanism in FIGS. 7 and 8 will be described. When the servo-motor 50 rotates, the threaded portion 66 moves laterally so that the arm 56 rotates with the connection member 52. Here, the lateral direction means the left and right direction in FIG. 7. Since the plate 6, the arms 56, 58, and the rod 60 constitute a quadric link, the arm 58 rotates with the arm 56 towards the same direction by the same angle. As a result, the pair of connection members 52, 52 rotate by the same angle.

The base portions of the screws 72 are fixed to the connection members 52, and the shanks of the screws 72 are supported by the association members 54. Therefore, when the connection members 52 rotate, the screws 72 also rotate, and the plate 6 advances and retracts relative to the base 4'. Here, the advancement and the retraction refer to motions along the lateral direction in FIG. 8. Since the arms 56, 58 rotate by the same angle, the plate 6 advances and retracts at its left and right positions by the same distance.

The functions of the embodiment and the modification will be described. The advancing and retracting mechanisms 28 in FIGS. 4 and 5 or the advancing and retracting mechanism in FIGS. 7 and 8 make the plate 6 advance and retract; therefore, the clearance between the tip end of the plate 6 and the ink fountain roller 32 is accurately adjusted with a small stroke.

With reference to FIG. 1, when the clearance between the tip end of the plate 6 and the ink fountain roller 32 can accurately be adjusted, the clearance is temporarily enlarged during printing so that the clogging dust to the clearance such as paper dust may be removed and after that the clearance may be returned to the previous value. Namely, in synchronization with enlarging the clearance between the tip end of the plate 6 and the ink fountain roller 32, a blade not shown is made in contact with the ink fountain roller 32 so that the dust such as paper dust is removed with ink. After the removal of the paper dust or the like, the clearance between the tip end of the plate 6 and the ink fountain roller 32 is returned to the previous value.

The time duration for enlarging the clearance is, for example, shorter than the rotational period of the ink fountain roller 32. During the time duration, the ink supply to the ductor roller not shown at the downstream of the roller 32 is stopped. Therefore, it is preferable to increase the contact time temporarily between the ductor roller and the ink fountain roller 32 so as to prevent the fluctuations of the printing density due to the removal of the paper dust and so on.

If the clearance between the tip end of the plate 6 and the ink fountain roller 32 changes between before and after the removal of the paper dust and so on, stable printing is hindered. Therefore, it is necessary to regulate accurately the clearance between the tip end of the plate 6 and the ink fountain roller 32; the advancing retracting mechanisms in FIGS. 4 to 8 are provided for this purpose. Further, the advancing and retracting mechanisms can be used to control the ink supply quantity according to the species of the ink and desired printing densities.

Other features in the embodiment will be described. When the friction between the plate 6 and base 4, 4' is made small, then small size motors can make the plate 6 advance and retract accurately. The thin sheet 8 retaining the balls 12 changes the friction between the plate 6 and the base 4, 4' to rotational friction for this purpose. Further, the large number of balls 12 support the plate 6 on its almost entire bottom surface.

When the clearance between the plate 6 and the base 4, 4' is large, ink, paper dust, cleaning liquid, and so on, may invade. These dust results in resistance to the rotation of the balls 12. It may be an option to provide permanent magnets to make the plate 6 adsorbed on the base 4, 4'. However, when the plate 6 is adsorbed on the base 4, 4' by the permanent magnets, a large force is necessary for advancing and retracting the plate 6. On the contrary, the resilient members 14 in FIG. 1 do not hinder the movement of the plate 6.

As described above, the resistance against the advancement and retraction of the plate 6 is made small by a large number of the balls 12 supporting the plate 6 and by the resilient members 14 energizing the plate 6 towards the base 4, 4'. In this way, the small output motors 41, 50 are made to advance and retract the plate accurately.

The plate 6 is regulated in its advancing and retracting position at the left and right two points. Therefore, the plate 6 does not tilt relative to the base 4, 4'. However, the plate 6 may shift along the longitudinal direction (left and right direction) of the base 4, 4'. Accordingly, the bearing roller 20 and the recess 22 shown in FIGS. 1 and 3 regulate the left and right position of the plate 6. Besides, if the bearing roller 20 is made in contact with the sidewalls of the recess 22, the wear of the bearing roller and the recess is very slight.

Consequently, the following meritorious results are resultant.

1) Without interruption of printing, the clogged dust such as paper dust in the clearance may be removed, by enlarging the clearance between the plate 6 and the ink fountain roller 32 temporarily. As a result, the decrease in the printing density due to the dust is eliminated. Further, after removing the dust, the clearance may accurately be returned to the previous value.

2) Since the plate 6 may be advanced and retracted by a small force, the small size motors may be used for the advancing and retracting mechanisms. Since the balls 12 are retained with grease in the holes 10, the printing press may operate without additional greasing for a long period, for example, for the service life of the printing press.

3) The bearing roller 20 and the recess 22 regulate the left and right position of the plate 6. Since the deformation of the bearing roller 20 and the recess 22 due to the wear is very small, the left and right position of the plate 6 is accurately regulated, for example, for the service life of the printing press.

Description of Reference Letters

| | | | |
|---|---|---|---|
| 2 | ink fountain device | 4, 4' | base |
| 6 | plate | 8 | thin sheet |
| 10 | hole | 12 | ball |
| 14 | resilient member | 16, 18 | hook |
| 19 | recess | 20 | bearing roller |
| 21 | roller part | 22 | recess |
| 24 | bearing | 26 | threaded hole |
| 28 | advancing and retracting mechanism | 30 | L-shaped piece |
| 31 | compressed spring | 32 | ink fountain roller |
| 33 | L-shaped piece | 34 | film |
| 35 | hole | 36, 38 | hole |
| 39 | cut-out portion | 40 | recess |
| 41 | servo-motor | 42 | driving shaft |
| 43 | cam | 44 | rod |
| 45 | adjustment screw | 46 | casing |
| 47 | attachment plate | 48 | knock pin |
| 50 | servo-motor | 52 | connection member |
| 54 | association member | 56, 58 | arm |
| 60 | rod | 62, 65 70 | pin |
| 64 | shaft | 66 | threaded portion |
| 68 | bracket | 72 | screw |
| 74 | threaded hole | | |
| g | clearance | | |

The invention claimed is:

1. An ink fountain device for forming an ink fountain when facing an ink fountain roller of a printing press, comprising:

a base; a plate; an advancing and retracting mechanism for advancing and retracting the plate along an advancing and retracting direction;

a thin sheet arranged on the base, having plural holes accommodating balls, and being thinner in thickness than a diameter of said balls;

wherein said plate is arranged over the thin sheet and supported by said balls; and wherein at least a bearing roller is provided on one of said base and said plate, and at least a recess accommodating the bearing roller is provided in the other of said base and said plate so that said bearing roller is made in contact with said recess when said plate is pressed to shift beyond an allowable range along a perpendicular direction to said advancing and retracting direction.

2. An ink fountain device for forming an ink fountain when facing an ink fountain roller of a printing press, comprising:

a base; a plate; an advancing and retracting mechanism for advancing and retracting the plate along an advancing and retracting direction;

a thin sheet arranged on the base, having plural holes accommodating balls, and being thinner in thickness than a diameter of said balls;

wherein said plate is arranged over the thin sheet and supported by said balls; and wherein said advancing and retracting mechanism comprises: a pair of motors joined to said base; a pair of cams rotating with output shafts of said pair of motors and having circumferential surfaces constituting cam surfaces; a pair of rods in contact with said cam surfaces and advancing and retracting along said advancing and retracting direction according to rotation of said motors; and a pair of connection members connecting said rods to said plate, so that said plate advances and retracts relative to said base by the same distance at two points.

3. An ink fountain device for forming an ink fountain when facing an ink fountain roller of a printing press, comprising:

a base; a plate; an advancing and retracting mechanism for advancing and retracting the plate along an advancing and retracting direction;

a thin sheet arranged on the base, having plural holes accommodating balls, and being thinner in thickness than a diameter of said balls;

wherein said plate is arranged over the thin sheet and supported by said balls;

wherein said advancing and retracting mechanism comprises: a pair of threaded holes provided on said plate; a pair of screws engaged with the pair of threaded holes; a pair of arms joined to said pair of screws; a rod connecting said pair of arms; a motor making one of said pair of arms rotate; and a pair of association members fixing axial positions of said pair of screws relative to said base;

wherein said plate, said pair of arms, and said rod constitute a quadric link; and wherein a member is rotatably attached on said one of said pair of arms, one of said member and an output shaft of said motor is provided with a screw, and another of said member and the output shaft of said motor is provided with a threaded hole such that the screw is engaged with the threaded hole.

* * * * *